US009133681B2

(12) United States Patent
Smith

(10) Patent No.: US 9,133,681 B2
(45) Date of Patent: Sep. 15, 2015

(54) PROTECTED RETAINING BANDS

(75) Inventor: Donald Smith, Wilson, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 719 days.

(21) Appl. No.: 13/464,711

(22) Filed: May 4, 2012

(65) Prior Publication Data

US 2013/0269929 A1 Oct. 17, 2013

Related U.S. Application Data

(63) Continuation-in-part of application No. 13/448,060, filed on Apr. 16, 2012, now abandoned.

(51) Int. Cl.
*E21B 33/128* (2006.01)
*E21B 33/12* (2006.01)

(52) U.S. Cl.
CPC ..... *E21B 33/1216* (2013.01)

(58) Field of Classification Search
CPC E21B 33/1208; E21B 33/1216; E21B 33/128
See application file for complete search history.

(56) References Cited

U.S. PATENT DOCUMENTS

| | | | |
|---|---|---|---|
| 3,358,766 | A | 12/1967 | Current |
| 5,540,279 | A | 7/1996 | Branch et al. |
| 5,701,959 | A | 12/1997 | Hushbeck et al. |
| 6,695,050 | B2 | 2/2004 | Winslow et al. |
| 6,695,051 | B2 | 2/2004 | Smith et al. |
| 6,896,061 | B2 | 5/2005 | Hriscu |
| 7,328,750 | B2 | 2/2008 | Swor et al. |
| 7,373,973 | B2 * | 5/2008 | Smith et al. ..... 166/134 |
| 2003/0226660 | A1 | 12/2003 | Winslow et al. |
| 2008/0060821 | A1 | 3/2008 | Smith et al. |
| 2011/0079383 | A1 | 4/2011 | Porter et al. |
| 2013/0192853 | A1 | 8/2013 | Themig |

FOREIGN PATENT DOCUMENTS

| | | | |
|---|---|---|---|
| CA | 2662406 | A1 | 3/2008 |
| CA | 2776789 | A1 | 4/2011 |
| CA | 2813650 | A1 | 4/2012 |
| WO | 2008032045 | A1 | 3/2008 |
| WO | 2011042685 | A1 | 4/2011 |
| WO | 2012045168 | A1 | 4/2012 |

OTHER PUBLICATIONS

Invitation to Pay Additional Fees and, Where Applicable Protest Fee, including Annex to Form PCT/ISA/206 Communication Relating to the Results of the Partial International Search dated May 8, 2014, in corresponding PCT Application No. PCT/US2013/023579.

International Search Report and Written Opinion of the International Searching Authority dated Jul. 4, 2014, filed in counterpart PCT Application No. PCT/US2013/023579.

* cited by examiner

*Primary Examiner* — Catherine Loikith
(74) *Attorney, Agent, or Firm* — McAfee & Taft, PC

(57) ABSTRACT

An improved downhole tool apparatus for limiting the extrusion of a sealing elements in downhole tools that use segmented retaining assemblies, retaining shoes or retaining limiters. The apparatus provides for locating the retaining bands for the retaining assemblies in a groove on the inner surface of the retaining assembly so that the bands are protected from breaking prematurely by inadvertently contacting the wellbore, casing within a wellbore, or other object.

15 Claims, 8 Drawing Sheets

PROTECTED RETAINING BANDS

CROSS-REFERENCE TO RELATED APPLICATION

The present application is a continuation-in-part of U.S. application Ser. No. 13/448,060 filed Apr. 16, 2012 now abandoned, and claims the benefit thereof.

BACKGROUND

The present invention relates to packer, bridge plug and frac plugs type tools used in wellbores and more particularly to retaining assemblies, such as extrusion limiters or retaining shoes, used in packer and bridge plug type tools.

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in a well. Downhole tools referred to as packers and bridge plugs are designed for these general purposes and are well known in the art of producing oil and gas.

When it is desired to remove many of these downhole tools from a wellbore, it is frequently simpler and less expensive to mill or drill them out rather than to implement a complex retrieving operation. In milling, a milling cutter is used to grind the packer or plug, for example, or at least the outer components thereof, out of the wellbore. In drilling, a drill bit is used to cut and grind up the components of the downhole tool to remove it from the wellbore. This is a much faster operation than milling, but requires the tool to be made out of materials that can be accommodated by the drill bit. To facilitate removal of packer type tools by milling or drilling, packers and bridge plugs have been made, to the extent practical, of non-metallic materials such as engineering grade plastics and composites.

Packer tools and other wellbore isolation devices sometimes have elements that undesirably protrude radially and inadvertently contact a wellbore, a casing within a wellbore, or other object. Such contact sometimes results in damage to the packer tool and/or premature transitioning of the device from a run in configuration to a set configuration. For example, some conventional slip segments of wellbore isolation devices are held together somewhat tightly against a mandrel through the use of one or more bands. The bands may be intended to stretch or fracture when the tool is activated in order to allow deployment. However, the bands often protrude radially and, thus, offer limited resistance to inadvertent deployment when the wellbore isolation device undergoes inadvertent perturbation.

SUMMARY

The present invention provides a downhole apparatus that is more resistant to inadvertent deployment than prior art downhole apparatuses.

In one embodiment of the invention there is provided a downhole apparatus for use in a wellbore. The apparatus has a mandrel having a longitudinal axial centerline and a radial direction perpendicular to the longitudinal axial centerline. A sealing assembly is disposed about the mandrel. The sealing assembly is radially expandable from an unset position to a set position in response to the application of axial force on the sealing assembly. In the set position the sealing assembly engages the wellbore. The invention also includes at least one retaining assembly for retaining the sealing assembly and resisting extrusion of the sealing assembly. The retaining assembly is proximate to the sealing assembly and has a plurality of segments disposed about the mandrel. The plurality of segments is adapted to resist extrusion of the sealing assembly and adapted to expand radially to engage the wellbore when the sealing assembly is in the set position. When the sealing assembly is in the unset position, the segments define an outer surface facing the wellbore and at least one end surface extending from the outer surface towards the mandrel. The end surface has a groove that extends around the end surface wherein the groove is not exposed to the wellbore. Additionally, at least when the sealing assembly is in the unset position, the retaining assembly further comprises a band positioned in the groove and suitable for holding the plurality of segments in place about the mandrel.

In another embodiment of the invention there is provided a retaining assembly for limiting the extrusion of a sealing assembly disposed about a mandrel. The sealing assembly is movable from an unset position to a set position in a wellbore, and the sealing assembly seals the wellbore when moved to the set position. The retaining assembly has a plurality of segments with each segment adjacent to at least one other segment. When the sealing assembly is in the unset position the segments define: an inner surface for encircling the mandrel; an outer surface; a first end surface for engaging an end of the sealing assembly and wherein the first end surface extends from the inner surface to the outer surface; and a second end surface opposing the first end surface and extending from the inner surface to the outer surface. Additionally, a first groove extends around the first end surface and a second groove extends around the second end surface. The first and second grooves are spaced from said outer surface. When in place about the mandrel and when the sealing assembly is in the unset position the retaining assembly further has a first band positioned in the first groove and a second band positioned in the second groove. The first band and second band are suitable for holding the plurality of segments in place about the mandrel while the sealing assembly is in the unset position.

BRIEF DESCRIPTION OF THE DRAWINGS

FIG. 6 is a perspective view of the retaining assembly of the present invention.

DETAILED DESCRIPTION

Figure 1:
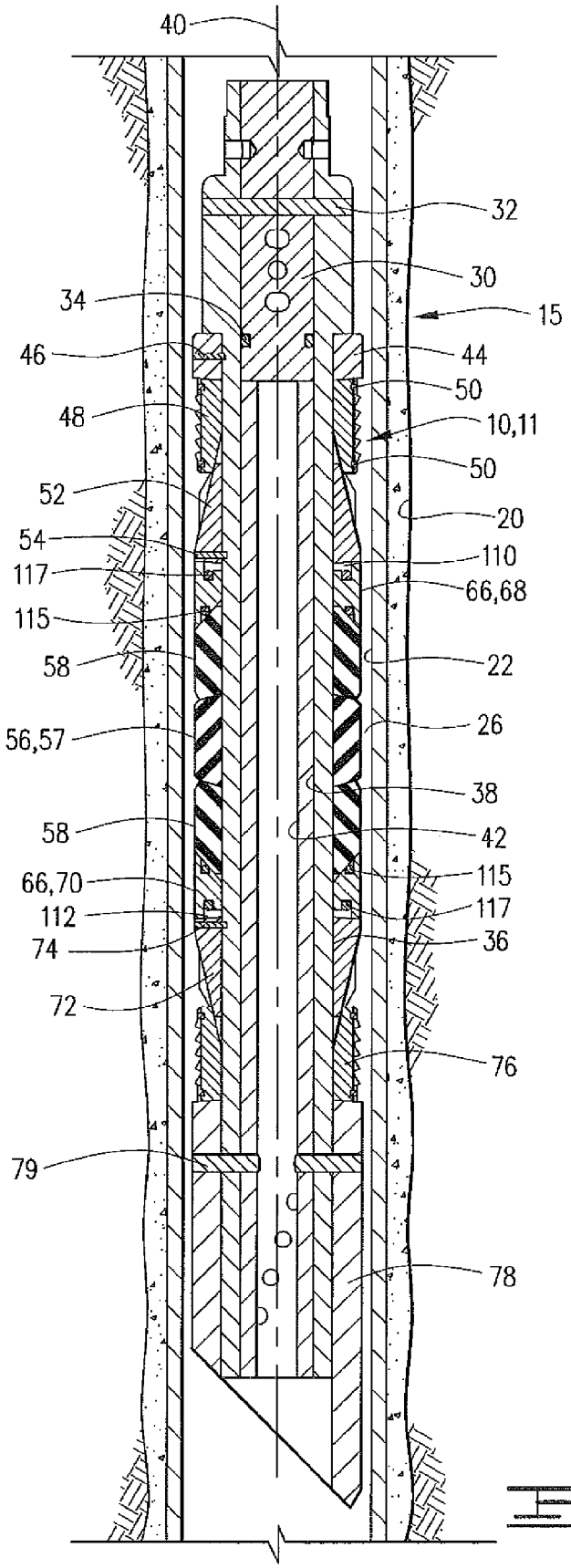
FIG. 1 is a cross-sectional side view of a downhole apparatus having retaining assemblies embodying the present invention.
Figure 2A:
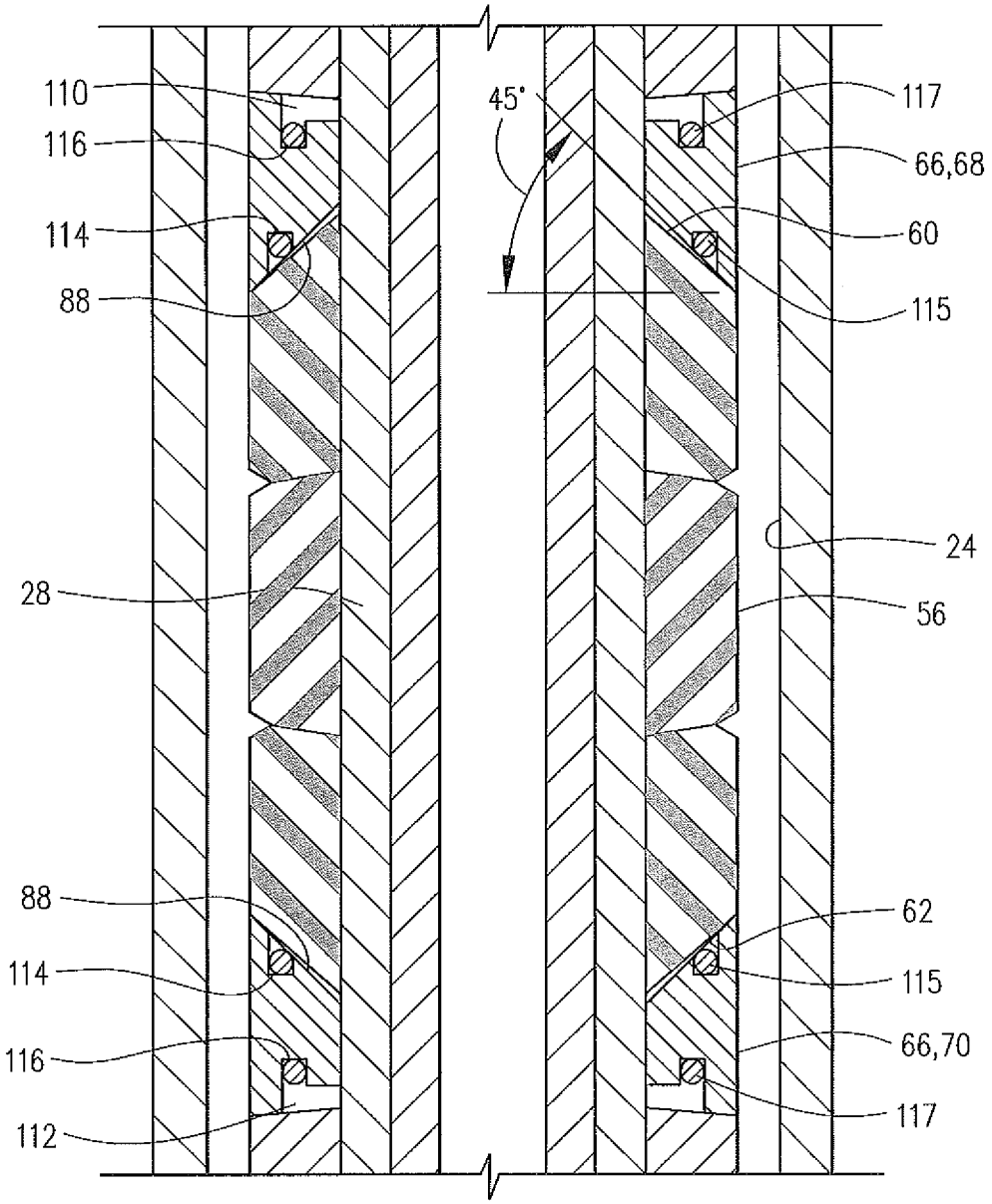
FIG. 2A is a cross-sectional side view of a sealing assembly and retaining assemblies of the embodiment of FIG. 1. of the present invention.
Figure 2B:
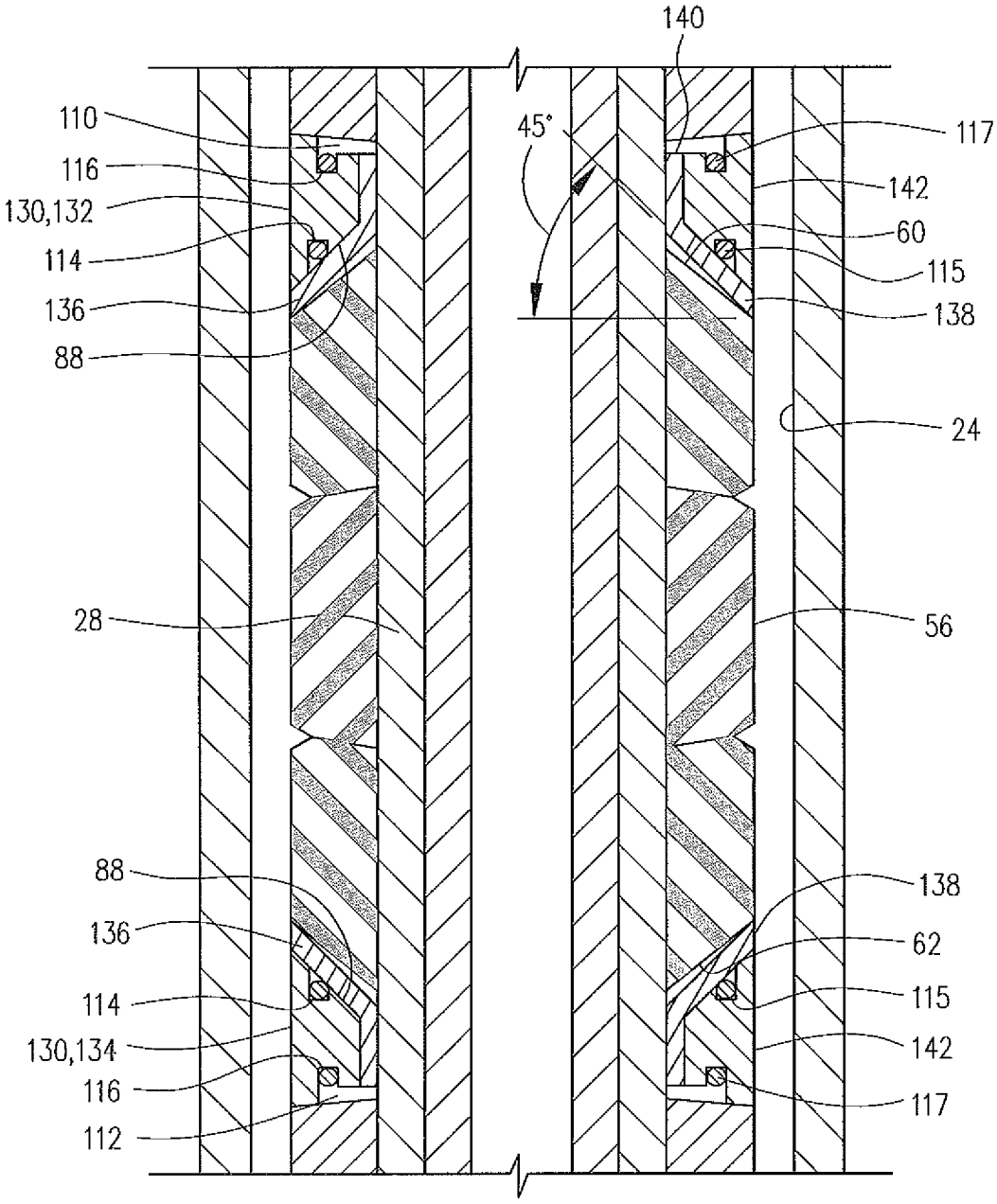
FIG. 2B is a cross-sectional side view of a sealing assembly and retaining assemblies of another embodiment of the present invention.
Figure 3:
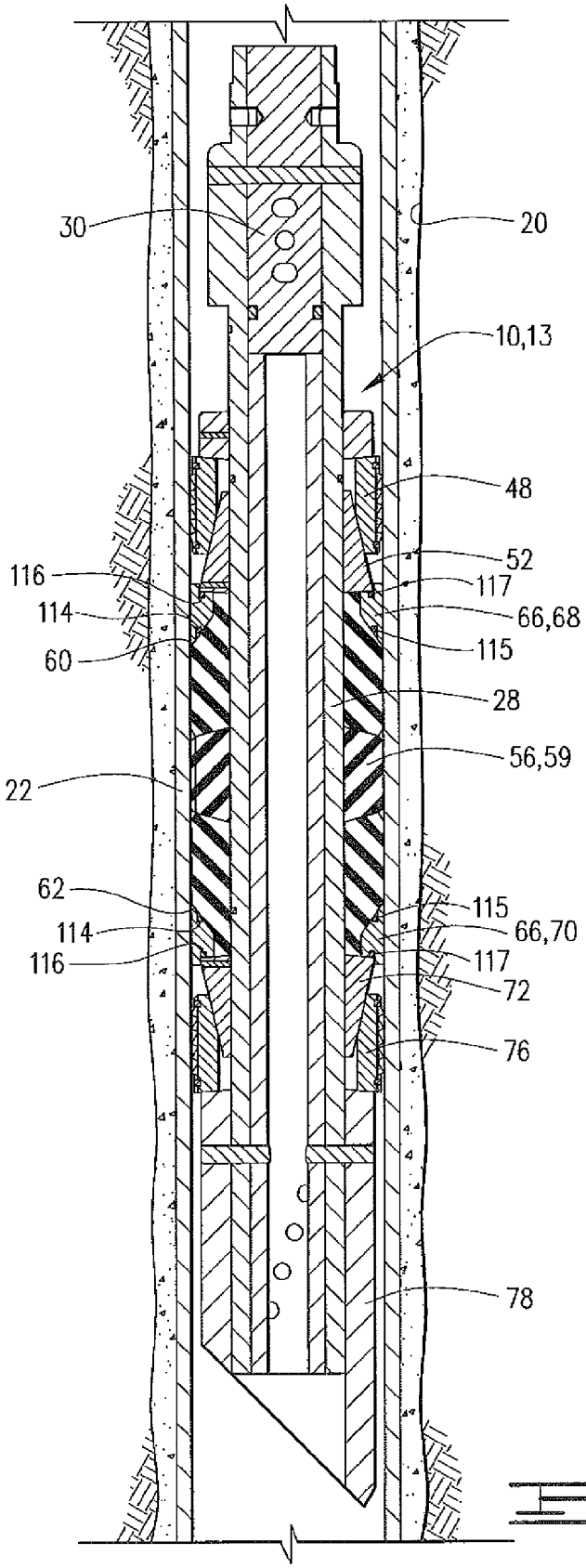
FIG. 3 is a cross-sectional side view of the downhole apparatus of the embodiment of FIG. 1 in a set position.
Figure 4:
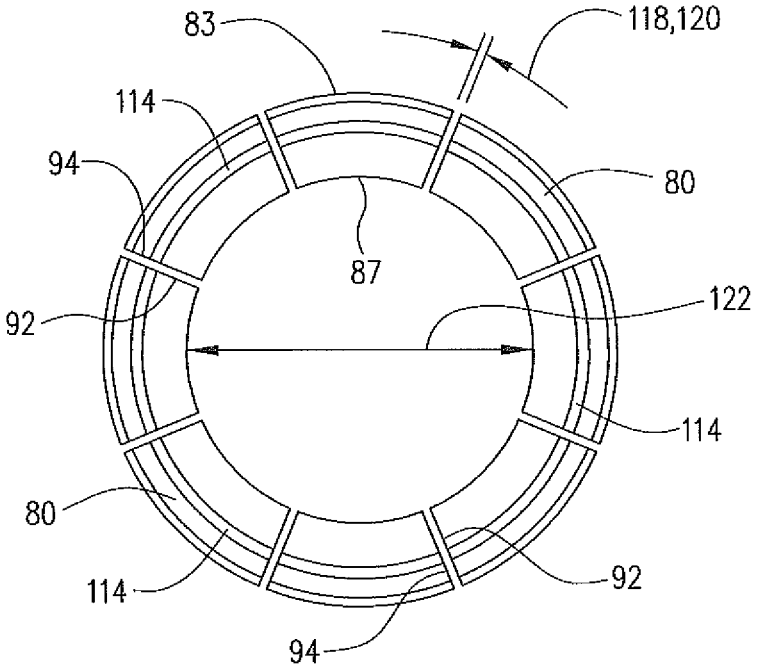
FIG. 4 is a front view of a retaining assembly of the present invention.

Referring now to FIGS. 1, 2 and 3, downhole tool, or downhole apparatus 10 is shown in an unset position 11 (FIGS. 1 and 2) or a set position 13 (FIG. 3) in a well 15 having a wellbore 20. The wellbore 20 can be either a cased completion with a casing 22 cemented therein as shown in FIG. 1 or an openhole completion. Generally, as used here in the term "wellbore" will refer to either a cased completion or an openhole completion. Downhole apparatus 10 is shown in set position 13 in FIG. 3. Casing 22 has an inner surface 24. An annulus 26 is defined by casing 22 and downhole tool 10. Downhole tool 10 has a mandrel 28, and may be referred to as a bridge plug due to the downhole tool 10 having a plug 30 being pinned within mandrel 28 by radially oriented pins 32. Plug 30 has a seal means 34 located between plug 30 and the internal diameter of mandrel 28 to prevent fluid flow therebetween. The overall downhole tool 10 structure, however, is adaptable to tools referred to as packers, and frac plugs which typically have at least one means for allowing fluid communication through the tool. Packers may therefore allow for the controlling of fluid passage through the tool by way of one or more valve mechanisms which may be integral to the packer body or which may be externally attached to the packer body. Frac plugs control fluid passage through the use of a frac ball. Such valve mechanisms are not shown in the drawings of the present document. Packer tools may be deployed in wellbores having casings or other such annular structure or geometry in which the tool may be set.

Mandrel 28 has an outer surface 36, an inner surface 38, and a longitudinal central axis, or longitudinal axial centerline 40. Also, as referred to herein the term "radially" will refer to a radial direction perpendicular to the longitudinal axial centerline. An inner tube 42 is disposed in, and is pinned to, mandrel 28 to help support plug 30.

Downhole tool 10, which as illustrated is a packer apparatus, includes the usage of a spacer ring 44 which is preferably secured to mandrel 28 by pins 46. Spacer ring 44 provides an abutment, which serves to axially retain slip segments 48 which are positioned circumferentially about mandrel 28. Slip retaining bands 50 serve to radially retain slip segments 48 in an initial circumferential position about mandrel 28 as well as slip wedge 52. Bands 50 are made of a steel wire, a plastic material, or a composite material having the requisite characteristics of having sufficient strength to hold the slip segments 48 in place prior to actually setting the downhole tool 10 and to be easily drillable when the downhole tool 10 is to be removed from the wellbore 20. Preferably, bands 50 are inexpensive and easily installed about slip segments 48. Slip wedge 52 is initially positioned in a slidable relationship to, and partially underneath, slip segments 48 as shown in FIG. 1. Slip wedge 52 is shown pinned into place by pins 54. Designs of slip segments 48 and co-acting slip wedges 52 are described in U.S. Pat. No. 5,540,279, which is incorporated herein by reference.

Located below slip wedge 52 is a sealing assembly 56, which includes at least one sealing element, and as shown in FIG. 1 includes three expandable sealing elements 58 positioned about mandrel 28. In packer type tools such sealing elements are often referred to as packer elements. Sealing assembly 56 has upper end 60 and lower end 62. Sealing assembly 56 has unset and set positions 57 (FIG. 1) and 59 (FIG. 3) corresponding to the unset and set positions 11 and 13, respectively, of downhole tool 10. The sealing assembly 56 is radially expandable from the unset position 57 to a set position 59 in response to the application of axial force on the sealing assembly 56. In the set position 59, the sealing assembly 56 engages the casing 22 to create a seal to prevent flow through annulus 26.

The present invention has retaining assemblies 66 disposed at the upper and lower ends 60 and 62 of sealing assembly 56 to axially retain the sealing assembly 56. Retaining assemblies 66 (also referred to as retaining shoes or extrusion limiters) may be referred to as an upper retaining assembly 68 and a lower retaining assembly 70. A slip wedge 72 is disposed on mandrel 28 below lower retaining assembly 70 and is pinned with a pin 74. Located below slip wedge 72 are slip segments 76. Slip wedge 72 and slip segments 76 are like slip wedge 52 and slip segments 48. At the lowermost portion of downhole tool 10 is an angled portion, referred to as mule shoe 78, secured to mandrel 28 by pin 79. The lowermost portion of downhole tool 10 need not be mule shoe 78 but can be any type of section which will serve to terminate the structure of the downhole tool 10 or serve to connect the downhole tool 10 with other tools, a valve or tubing, etc. It will be appreciated by those in the art that pins 32, 46, 54, 74, and 79, if used at all, are preselected to have shear strengths that allow for the downhole tool 10 to be set and deployed and to withstand the forces expected to be encountered in the wellbore 20 during the operation of the downhole tool 10.

Figure 8:
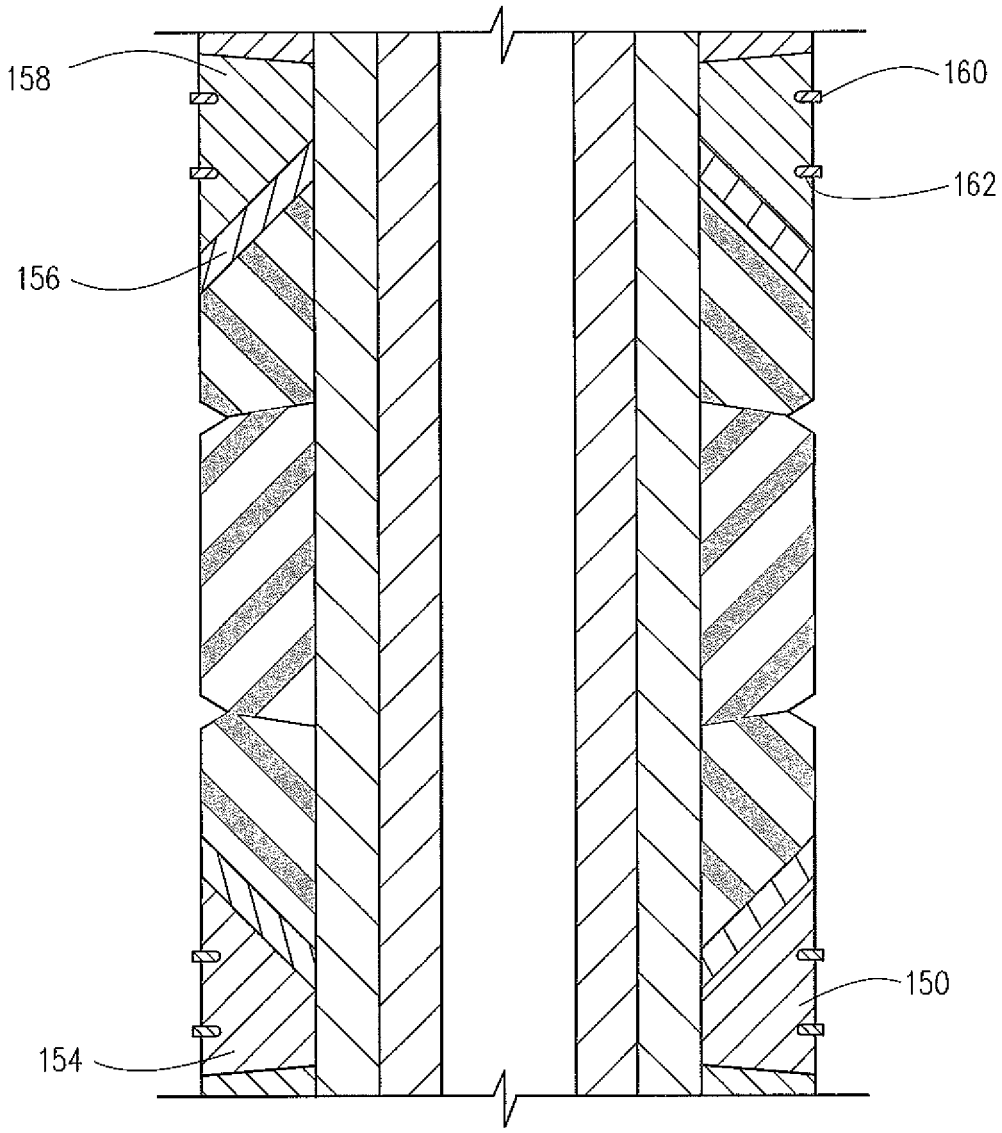
FIG. 8 PRIOR ART
FIG. 8 is a cross-sectional side view of a prior art packer element and retaining assembly.

FIG. 8 shows a prior art arrangement of a retaining assemblies 150, which may referred to as retaining shoes or extrusion limiters. Upper and lower retaining assembly 152 and 154 are essentially identical. Therefore, the same designating numerals will be used to further identify features on each of retaining shoes 152 and 154, which are referred to collectively herein as retaining assemblies 150. Retaining assemblies 150 comprise an inner shoe, or inner retainer 156 and an outer shoe, or outer retainer 158 Inner and outer shoes 156 and 158 are held in place by retaining bands 160, which are received in a groove 162. Retaining bands 160 are exposed so that they can undergo inadvertent contact with a wellbore, a casing within a wellbore, or other object.

Referring now to FIGS. 2A and 4-7, the retaining assemblies 66 (also called retaining shoes or extrusion limiters) of the present invention will be described. Upper and lower retaining assemblies 68 and 70 are essentially identical. Therefore, the same designating numerals will be used to further identify features on each of retaining assemblies 68 and 70, which are referred to collectively herein as retaining assemblies 66. Retaining assemblies 66 are preferably comprised of a plurality of retainer segments, or shoe segments, 80 to form retaining assemblies 66 that encircles mandrel 28. Retainer segments 80 can be made form any suitable material that will withstand the downhole use and yet can be readily cut or ground up by drilling with a drill bit. Generally, non-metallic engineering grade plastics can be used for the retaining materials, such as composite materials or structural phenolic materials. A suitable phenolic materials are available from General Plastics & Rubber Company, Inc., 5727 Ledbetter, Houston, Tex. 77087-4095. Alternatively, structural phenolics available from commercial suppliers may be used. A suitable composite materials are available from General Plastics & Rubber Company, Inc., 5727 Ledbetter, Houston, Tex. 77087-4095. Particularly suitable materials for at least a portion retaining assemblies 66 includes direction specific composite material available from General Plastics & Rubber Company, Inc.

Retaining assemblies 66 have an outer surface 82. Retaining assemblies 66 also have an inner surface 84 composed of inner surface 86, first end surface 88 and second end surface 90. When the downhole tool is in the unset position 11, retaining segments 80 define outer surface 82 and inner surface 84. Generally outer surface 82 will be substantially cylindrical and face the wellbore 20. In the set position 13, the arc surfaces 83 of retaining segments 66 making up outer surface 82 engage the wellbore. Generally inner surface 86 will be a substantially cylindrical inner surface, which encircles the mandrel. Timer surface 86 is defined by arc surfaces 87 of retaining segments 66. Arc surfaces 87 engage mandrel 28 in an initial or running position of the downhole tool 10. First end surface 88 extends from the outer surface 82 to inner circle 86. Additionally, first end surface 88 extends in a generally circumferential direction but is preferably not parallel to the radial direction. As can best be seen from FIG. 6, first end surface 88 can have an arcuate shaped cross-section or can be sloped. In the embodiment shown, first end surface 88 is shaped to accommodate the upper and lower ends 60 and 62 of the sealing assembly 56 and, thus, is preferably sloped as well as arcuate to provide a generally truncated conical surface which transitions from having a greater radius proximate outer surface 82 to a smaller radius proximate substantially cylindrical inner surface 86. Second end surface 90 opposes first end surface 88 and, hence, extends from the outer surface 82 to inner circle 86. Additionally, second surface 90 extends in a generally circumferential direction. Second end surface 90 may be generally parallel to the radial direction or may be at a slight angle, preferably less than 10° from parallel to the radial direction. However, it is within the scope of the invention for both end surfaces (first end surface 88 and second end surface 90) to have other shapes as long as they generally extend circumferentially and from outer surface 82 to inner surface 86.

Figure 5:
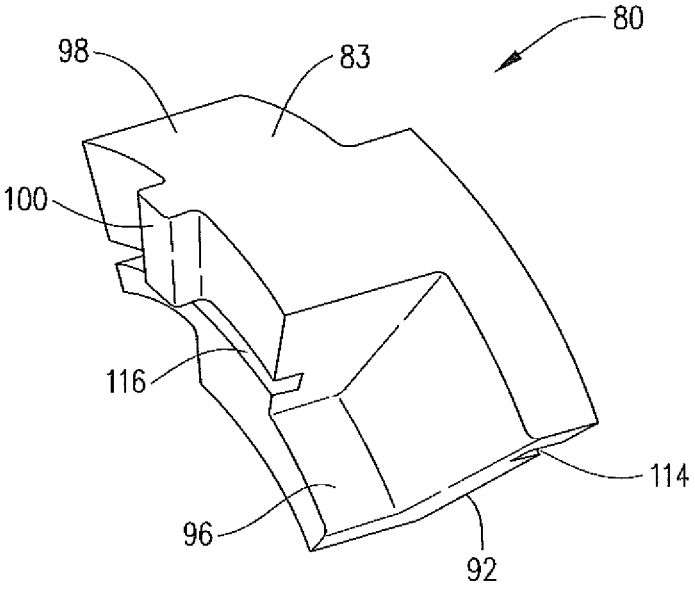
FIG. 5 is a perspective view of a single retaining assembly segment.
Figure 5:
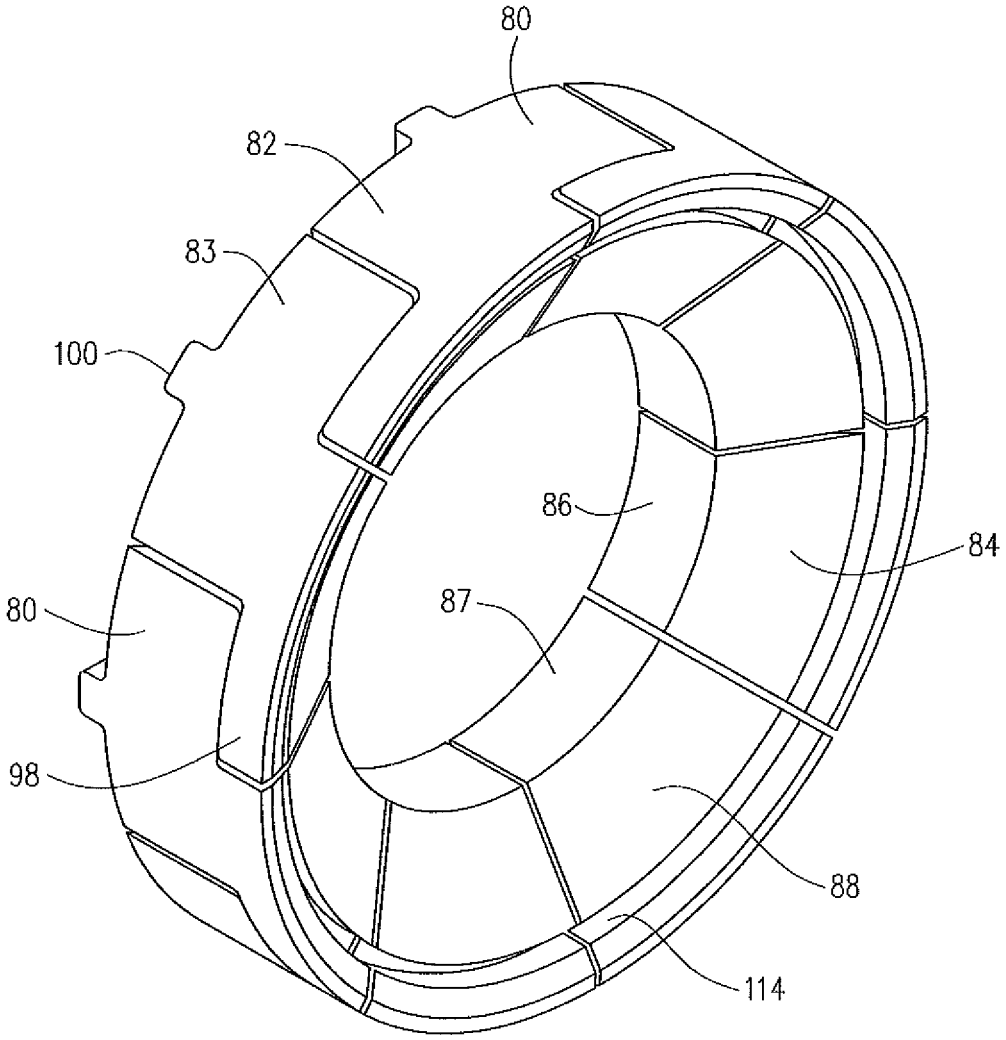
Figure 7:
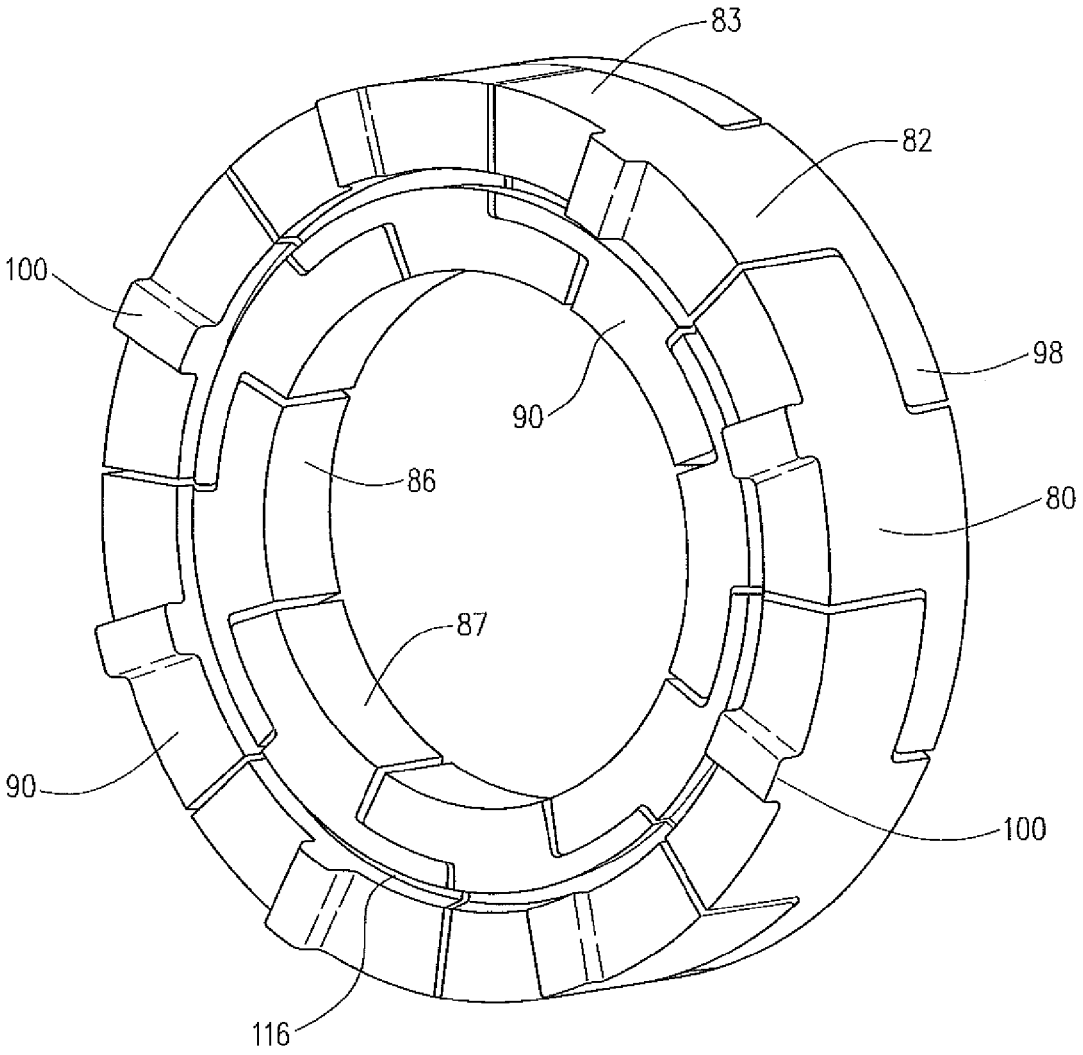
FIG. 7 is a perspective view of the retaining assembly of the present invention as viewed from the opposite side as the view of FIG. 6.

As shown in FIG. 2, upper and lower ends 60 and 62 of sealing assembly 56 reside directly against upper and lower retaining assemblies 68 and 70. Retaining assemblies 66 are preferably comprised of a plurality of retainer segments 80 that encircles mandrel 28. Each retainer segment 80 has ends 92 and 94, which can be flat and convergent with respect to a center reference point, which, if the retainer segments 80 are installed about mandrel 28, will correspond to the longitudinal central axis 40 of the mandrel 28 as depicted in FIG. 1. Ends 92 and 94 need not be flat and can be of other topology. In a preferred embodiment end 92 has a shelf 96 and end 94 has a tongue portion 98, as can be seen in FIGS. 5 and 6. Tongue portion 98 is adapted to be received onto shelf 96 so that, in the unset position 11, retainer segments overlap and form a substantially continuous ring. Further tongue portion 98 and shelf 96 are adapted so that, when retaining assemblies 66 are expanded in the set position 13, the retaining segments still overlap and extrusion of the sealing elements 58 through the gaps 118 between retaining segments is blocked by the tongue and shelf arrangement.

FIG. 4-7 illustrate retaining assemblies 66 being made of a total of eight retainer segments 80 to provide a 360 degrees annulus encircling structure to provide a maximum amount of end support for sealing elements 58 to be retained in the axial direction. A lesser or greater amount of retainer segments 80 can be used depending on the nominal diameters of the mandrel 28, the sealing elements 58, and the wellbore 20 or casing 22 in which the downhole tool 10 is to be deployed. Inner diameter 122 generally approaches the inner diameter of the sealing assembly 56. As is apparent from the drawings, outer surface 82 faces outwardly away from the downhole tool 10. The slope of first end surface 88 is preferably approximately 45 degrees as shown in FIG. 2. However, the exact slope will be determined by the exterior configuration of the ends of the sealing elements 58 that are to be positioned and eventually placed in contact with retaining assemblies 66 and first end surface 88. Inner surface 86 of retaining assembly 66 can be slightly sloped, approximately 5 degrees if desired, but it is best determined by the surface of the downhole tool 10 which it eventually abuts against when downhole apparatus 10 is centered in the wellbore 20.

Each retainer segment 80 can have a lug (protruding member) 100 extending out from second end 90. As can be seen from FIGS. 1 and 2, the lugs 100 of upper retaining assembly 68 contacts or abuts a slip wedge 52 such that an upper gap 110 is created when the downhole tool is in the unset position 11. As can be seen in FIG. 3, when the downhole tool is moved to the set position, tipper retaining assembly 68 expands allowing slip wedge 52 to slide under the lugs 100 and fill gap 110 such that the end of the slip wedge that abutted the lugs is now between the lugs and the mandrel. Similarly, the lugs 100 of lower retaining assembly 70 contacts slip wedge 72 such that a lower gap 112 is created when the downhole tool is in the unset position. Also, when the downhole tool is moved to the set position, upper retaining assembly 70 expands allowing slip wedge 72 to slide under the lugs 100 and fill gap 112.

An important aspect of the current invention is groove 114 and 116. Groove 114 extends circumferentially around the first end surface 88. Groove 116 extends circumferentially around the second end surface 90. Retaining band 115 is positioned in groove 114 and retaining band 117 is positioned groove 116. Retaining bands 115 and 116 are received in grooves 114 and 116 to initially hold the retainer segments 80 in place prior to setting the downhole tool 10 into the set position 13. It is a preferred embodiment that the grooves 114 and 116 and retaining bands 115 and 117 be located on inner surface 84 instead of outer surface 82. More preferably the grooves 114 and 116 and retaining bands 115 and 117 should be located on first end surface 88 and second end surface 90. The grooves 114 and 116 should be spaced from outer surface 82, i.e., not exposed to the wellbore 20 or not facing the wellbore 20. Location of the bands and grooves in these positions prevent contacts that might fracture or release the bands and result in premature expansion of the retainer segments 80. Retaining bands 115 and 117 may be made of a nonmetallic material, such as composite materials available from General Plastics & Rubber Company, Inc., 5727 Ledbetter, Houston, Tex. 77087-4095. However, bands 114 and 116 may be alternatively made of a metallic material such as ANSI 1018 steel or any other material having sufficient strength to support and retain the retaining assembly 66 in position prior to actually setting the downhole tool 10. Furthermore, retaining bands 115 and 117 may have either elastic or non-elastic qualities depending on how much radial, and to some extent axial, movement of the retainer segments 80 can be tolerated prior to enduring the deployment of the associated downhole tool 10 into the wellbore 20.

In unset position 57, retaining bands 115 and 117 serve to hold retainer segments 80 in place. Prior to the downhole tool 10 being set, retaining assemblies 66 engage mandrel 28 about the upper and lower ends 60 and 62 of the sealing assembly 56. Lower retaining assembly 70 engages lower end 62 of sealing assembly 56 and upper retaining assembly 68 engages the upper end 60 of sealing assembly 56 in the unset positions 11 and 57 of downhole tool 10 and the sealing assembly 56, respectively. When the downhole tool 10 has reached the desired location in the wellbore 20, setting tools as commonly known in the art will move the downhole tool 10 and, thus, the sealing assembly 56, to their set positions 13 and 59, respectively, as shown in FIG. 3.

Gaps 118 have a width 120 that can be essentially zero when the retainer segments 80 are initially installed about mandrel 28, and before the downhole tool 10 is moved from the unset position 11 to the set position 13. However, a small gap, for example a gap of 0.06" may be provided for on initial installation. The width 120 of gap 118 will increase from that which exists on initial installation, as the downhole tool 10 is set.

When the downhole tool 10 is moved to its set position 13, retaining bands 115 and 117 will break and retaining assembly 66 will move radially outwardly so that arc surfaces 83 of each retainer segment 80 will engage inner surface 24 of casing 22. The radial movement will cause width 120 of gaps 118 to increase. However, the tongue portion 98 and shelf 96 of retainer segments 80 will still overlap and, thus, extrusion of sealing elements 58 through gaps 118 and past retaining assembly 66 will be prevented. Additionally, the slip wedges 52 and 72 will move under lugs 100, as described above. Accordingly, slip wedges 52 and 72 will prevent extrusion of sealing elements 58 between retaining assembly 66 and mandrel 28 as illustrated in FIG. 3.

As can be understood from the foregoing description, the extrusion of sealing elements 58 is essentially eliminated, since arc surface 83 engage the wellbore 20 and prevent extrusion on the wellbore side of the downhole tool. Additionally, any material extruded through gaps 118 will be blocked by the tongue and shelf arrangement of the retainer segments, extrusion between retainer segments 80 and mandrel 28 is blocked by the slip wedges 52 and 72. Retaining assemblies 66 are thus expandable retaining shoes that will prevent or at least limit the extrusion of the sealing elements 58 and be less subject to premature expansion. Retaining assembly 66 may also be referred to as an expandable retainer. The arrangement is particularly useful in high pressure, high temperature wells, since there is no extrusion path available. It should be understood, however, that the disclosed retaining assembly 66 may be used in connection with packer-type tools of lesser or greater diameters, differential pressure ratings, and operating temperature ratings than those set forth herein.

Turning now to FIG. 2B an alternative embodiment of the invention is shown. In FIG. 2B similar parts to those in FIG. 2A have been given the same reference number. In the embodiment of FIG. 2B there is upper retaining assembly 132 and lower retaining assembly 134. Upper and lower retaining assemblies 134 are essentially identical. Therefore the same designating numerals will be used to further identify features on each of retaining assemblies 132 and 134, which are referred to collectively herein as retaining assemblies 130. Retaining assemblies 130 comprising an inner ring 136 and an outer ring 142. Inner ring 136 can have an arcuate or an angular cross section and mates with outer ring 142, such that radial portion 138 is between outer ring 142 and either the upper or lower end of the sealing assembly 60 or 62 and such that the longitudinal or axial portion 140 of inner ring 136 is between mandrel 28 and outer ring 142. Additionally, inner ring 136 can be comprised of a plurality of segments with each segment adjacent to at least one other segment. Outer ring 142 is essentially identical to retaining assemblies 66, except that it has a larger inner diameter 122 to accommodate inner ring 136.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. An apparatus for use in a wellbore, comprising:

a mandrel having a longitudinal axial centerline and a radial direction perpendicular to said longitudinal axial centerline;

a sealing assembly disposed about said mandrel, wherein said sealing assembly is radially expandable from an unset position to a set position in response to application of axial force on said sealing assembly wherein said sealing assembly engages said wellbore in said set position; and a retaining assembly for retaining said sealing assembly and resisting extrusion of said sealing assembly, said retaining assembly proximate to said sealing assembly and comprising:

a plurality of segments disposed about said mandrel, adapted to resist extrusion of said sealing assembly, and adapted to expand radially to engage said wellbore when said sealing assembly is in said set position; wherein, when said sealing assembly is in said unset position, said segments define:

an outer surface facing said wellbore;

a first end surface extending from said outer surface toward said mandrel and having a first groove that extends around said first end surface; and a second end surface extending from said outer surface toward said mandrel and having a second groove that extends around said second end surface, wherein said first and second grooves are not exposed to said wellbore;

a slip wedge encircling and slidable along a portion of said mandrel wherein a first end of said slip wedge abuts said second end surface and said first end surface abuts a first end of said sealing assembly, and wherein said second end surface has at least one protruding member positioned so that when said sealing assembly is in said unset position said first end of said slip wedge abuts said protruding member, and when said sealing assembly is in said set position said first end of slip wedge is between said mandrel and said protruding member.

2. The apparatus of claim 1 wherein said first groove has a first band positioned therein, said second groove has a second band positioned therein and wherein said first band and said second bands are suitable for holding said plurality of segments in place about said mandrel while said sealing assembly is in said unset position.

3. The apparatus of claim 1 wherein each of said segments are adjacent to at least one segment and said thus adjacent segments circumferentially overlap each other such that, when said sealing assembly is in said set position, extrusion of said sealing assembly between said adjacent segments is blocked.

4. The apparatus of claim 3, wherein adjacent segments have adjacent segment-facing ends, which have a tongue-and-shelf interaction such that the tongue on one of the adjacent segment-facing ends is received onto the shelf on another segment-facing end such that the adjacent segments circumferentially overlap such that extrusion of said sealing assembly between said adjacent segments is blocked when said sealing is in said set position.

5. An apparatus for use in a wellbore, comprising:

a mandrel having a longitudinal axial centerline and a radial direction perpendicular to said longitudinal axial centerline;

a sealing assembly disposed about said mandrel, wherein said sealing assembly is radially expandable from an unset position to a set position in response to application of axial force on said sealing assembly wherein said sealing assembly engages said wellbore in said set position; and a retaining assembly for retaining said sealing assembly and resisting extrusion of said sealing assembly, said retaining assembly proximate to said sealing assembly and comprising:

a plurality of segments disposed about said mandrel, adapted to resist extrusion of said sealing assembly, and adapted to expand radially to engage said wellbore when said sealing assembly is in said set position; wherein, when said sealing assembly is in said unset position, said segments define an outer surface facing said wellbore and at least one end surface extending from said outer surface towards said mandrel; and wherein said end surface has a groove that extends around said end surface, wherein said groove is not exposed to said wellbore; and when said sealing assembly is in said unset position, said segments define:

a first end surface extending from said outer surface toward said mandrel and having a first groove that extends end around said first end surface, wherein said first groove is not exposed to said wellbore, and as second end surface extending from said outer surface toward said mandrel and having a second groove that extends around said second end surface, wherein said second groove is not exposed to said wellbore;

wherein when said sealing assembly is in said unset position, said first groove has a first band positioned therein, said second groove has a second band positioned therein and said first and said second band are suitable for holding said plurality of segments in place about said mandrel; and each of said segments are adjacent to at least one other segment and said thus adjacent segments have adjacent segment-facing ends, which have a tongue-and-shelf interaction such that the tongue on one of the adjacent segment-facing ends is received onto the shelf on another segment-facing end such that the adjacent segments circumferentially overlap each other such that, when said sealing assembly is in said set position, extrusion of said sealing assembly between said adjacent segments is blocked.

6. A retaining assembly for limiting extrusion of a sealing assembly disposed about a mandrel, wherein said sealing assembly is movable from an unset position to a set position in a wellbore, and said sealing assembly seals said wellbore when moved to said set position, said retaining assembly comprising:

a plurality of segments with each segment adjacent to at least one other segment and said thus adjacent segments have adjacent segment-facing ends, which have a tongue-and-shelf interaction such that the tongue on one of the adjacent segment-facing ends is received onto the shelf on another segment-facing end such that the adjacent segments circumferentially overlap each other such that, when said sealing assembly is in said set position, extrusion of said sealing assembly between said adjacent segments is blocked, and wherein, when said sealing assembly is in said unset position, said segments define:

an inner surface for encircling said mandrel;

an outer surface exposed to the wellbore;

a first end surface for engaging an end of said sealing assembly and wherein said first end surface extends from said inner surface to said outer surface; and a second end surface opposing said first end surface and extending from said inner surface to said outer surface;

wherein said plurality of segments have a first groove that extends around said first end surface and a second groove that extends around said second end surface and wherein said first groove and second groove are spaced from said outer surface.

7. The apparatus of claim 6 wherein said retaining assembly further comprises a first band positioned in said first groove and a second band positioned in said second groove wherein said first band and second band are suitable for holding said plurality of segments in place about said mandrel while said sealing assembly is in said unset position.

8. The apparatus of claim 6 wherein each of said adjacent segments circumferentially overlap each other such that, when said sealing assembly is in said set position, extrusion of said sealing assembly between said adjacent segments is blocked.

9. The apparatus of claim 6 wherein said second end surface has at least one lug positioned between said substantially cylindrical outer surface and said second groove.

10. The apparatus of claim 9 wherein:

when said sealing assembly is in said unset position, said retaining assembly further comprises a first band positioned in said first groove and a second band positioned in said second groove wherein said first band and second band are suitable for holding said plurality of segments in place about said mandrel while said sealing assembly is in said unset position; and said second end surface has at least one lug positioned between said substantially cylindrical outer surface and said second groove.

11. Apparatus for use in a wellbore, comprising:

a mandrel having a longitudinal axial centerline and a radial direction perpendicular to said longitudinal axial centerline;

a sealing assembly disposed about said mandrel, wherein said sealing assembly is radially expandable from an unset position to a set position in response to application of axial force on said sealing assembly wherein said sealing assembly engages said wellbore in said set position, and a first retaining assembly for limiting extrusion of the sealing assembly, said retaining assembly comprising:

a plurality of segments with each segment adjacent to at least one other segment and said thus adjacent segments have adjacent segment-facing ends, which have a tongue-and-shelf interaction such that the tongue on one of the adjacent segment-facing ends is received onto the shelf on another segment-facing end such that the adjacent segments circumferentially overlap each other such that, when said sealing assembly is in said set position, extrusion of said sealing assembly between said adjacent segments is blocked, and, wherein when said sealing assembly is in said unset position, said segments define:

an inner surface for encircling said mandrel;

an outer surface;

a first end surface for engaging an end of said sealing assembly and wherein said first end surface extends from said inner surface to said outer surface; and a second end surface opposing said first end surface and extending from said inner surface to said outer surface;

wherein said plurality of segments have a first groove that extends around said first end surface and a second groove that extends around said second end surface, and wherein said first groove and said second groove are spaced from said outer surface.

12. The apparatus of claim 11 wherein said first retaining assembly further comprises a first band positioned in said first groove and a second band positioned in said second groove wherein said first band and second band are suitable for holding said plurality of segments in place about said mandrel while said sealing assembly is in said unset position.

13. The apparatus of claim 11 further comprising a slip wedge encircling and slidable along a portion of said mandrel wherein a first end of said slip wedge abuts said second end surface.

14. The apparatus of claim 13 wherein said second end surface has at least one lug positioned so that when said sealing assembly is in said unset position said first end of said slip wedge abuts said lug, and when said sealing assembly is in said set position said first end of slip wedge is between said mandrel and said lug.

15. The apparatus of claim 11 further comprising a slip wedge encircling and slidable along a portion of said mandrel and wherein:

when said sealing assembly is in said unset position, said first retaining assembly further comprises a first band positioned in said first groove and a second band positioned in said second groove wherein said first band and second band are suitable for holding said plurality of segments in place about said mandrel while said sealing assembly is in said unset position;

each of said adjacent segments circumferentially overlap each other such that, when said sealing assembly is in said set position, extrusion of said sealing assembly between said adjacent segments is blocked; and said second end surface has at least one lug positioned so that when said sealing assembly is in said unset position a first end of said slip wedge abuts said lug, and when said sealing assembly is in said set position said first end of slip wedge is between said mandrel and said lug.

* * * * *